US007338295B2

(12) United States Patent
Wooden

(10) Patent No.: US 7,338,295 B2
(45) Date of Patent: Mar. 4, 2008

(54) TEST SOCKET-LID ASSEMBLY

(75) Inventor: Gregg Wooden, Santa Clara, CA (US)

(73) Assignee: Protos Electronics

( * ) Notice: Subject to any disclaimer, the term of this patent is extended or adjusted under 35 U.S.C. 154(b) by 0 days.

(21) Appl. No.: 11/490,276

(22) Filed: Jul. 21, 2006

(65) Prior Publication Data

US 2008/0020623 A1 Jan. 24, 2008

(51) Int. Cl.
*H01R 13/62* (2006.01)

(52) U.S. Cl. ..... 439/73; 439/331; 324/755; 324/760

(58) Field of Classification Search ..... 439/73, 439/331, 330, 71, 525, 526; 324/755, 760
See application file for complete search history.

(56) References Cited

U.S. PATENT DOCUMENTS

| | | | | |
|---|---|---|---|---|
| 5,808,474 | A | 9/1998 | Hively et al. | |
| 5,865,639 | A * | 2/1999 | Fuchigami et al. | 439/330 |
| 6,152,744 | A | 11/2000 | Maeda | |
| 6,353,329 | B1 | 3/2002 | Kiffe | |
| 6,447,322 | B1 | 9/2002 | Yan et al. | |
| 6,710,612 | B2 | 3/2004 | Farnworth et al. | |
| 6,749,443 | B2 * | 6/2004 | Sano et al. | 439/71 |
| 6,811,421 | B1 | 11/2004 | Gatuso et al. | |
| 7,021,954 | B2 * | 4/2006 | Gattuso et al. | 439/342 |
| 7,108,517 | B2 * | 9/2006 | Harper | 439/71 |
| 7,230,830 | B2 * | 6/2007 | Ujike et al. | 361/704 |
| 7,267,554 | B2 * | 9/2007 | Huang | 439/73 |
| 2005/0164530 | A1 * | 7/2005 | Yates et al. | 439/73 |
| 2005/0181654 | A1 * | 8/2005 | Watanabe | 439/331 |
| 2006/0110953 | A1 | 5/2006 | Allsup | |

OTHER PUBLICATIONS

Ball and Spring Plungers, S&W Manufacturing (http://www.swmanufacturing.com/sub/ball_spring_plungers.asp).

* cited by examiner

*Primary Examiner*—Gary F. Paumen

(57) ABSTRACT

A test socket-lid assembly for testing electronic devices such as IC chips consists of a socket sub-assembly and a lid-sub-assembly, which is separated from the socket sub-assembly. In the lid sub-assembly, the lid is pivotally connected to the frame and supports a spring-loaded pusher that can slide in a vertical direction relative to the lid and can perform rocking movements relative to the lid. The assembly is distinguished from existing devices of this type in that the IC chip is supported and clamped in the lid sub-assembly and in that the entire lid sub-assembly together with the clamped and spring-loaded pusher is attached to the socket by guiding the lid sub-assembly in a transverse direction along the socket guide to the position wherein the spring plungers are locked into their respective openings on the surface of the socket. In one embodiment the pusher is a single part that has three degrees of freedom relative to the IC chip; in another embodiment, the pusher is of a composite structure and has five degrees of freedom.

24 Claims, 5 Drawing Sheets

TEST SOCKET-LID ASSEMBLY

FIELD OF THE INVENTION

The invention relates to devices for testing integrated-circuit chips, in particular to test socket-lid assemblies for holding integrated-circuit chips during testing.

BACKGROUND OF THE INVENTION

Increased capabilities of integrated-circuit chips (hereinafter referred to as IC chips) have led to increased input/output (I/O) densities and modified techniques for mounting IC chips to printed circuit (PC) boards involving IC chips. In view of the above, designs of IC test sockets for holding IC chips during their temporary connection to testing equipment are constantly being improved and modified. The existing lid-socket assemblies can roughly be divided into two main groups: (1) socket assemblies wherein the lid subassembly is separated from the socket sub-assembly and can be connected to the latter by clamps or locking mechanisms; and (2) socket assemblies wherein the lid sub-assembly is constantly pivotally connected to the socket.

For example, U.S. Pat. No. 5,865,639 issued in 1999 to M. Fuchigami, et al. describes a test socket that can be used for testing an electronic assembly. The test socket has a holder having a recess for receiving the electronic assembly. Heat sinks are pivotally secured to the holder and are biased from a loading position, wherein the electronic assembly can be located in the holder, to a testing position wherein the heat sinks contact the surface of an integrated circuit of the electronic assembly. Heat sinks have large mass and velocity, and therefore have kinetic energy when they strike an integrated circuit. Impact forces created by heat sinks on integrated circuits often result in damage to the integrated circuits.

The problem inherent in the test socket of the above patent is solved by U.S. Pat. No. 6,447,322 issued in 2002 to H. Yan. This patent describes a test socket for an electronic assembly that comprises a holder, a plurality of electric terminals, a heat sink, a compliant and thermally conductive thermal interface component, and a heat sink biasing device. The holder has a formation to receive the electronic assembly. The electric terminals are located on the holder, each for making contact with a respective electric contact and with the electronic assembly in order to test an integrated circuit of the electronic assembly. The heat sink is secured to the holder. The thermal interface component is attached to the surface of the heat sink. The heat sink biasing device has a first portion connected to the holder and a second portion connected to the heat sink, the second portion being biased relative to the first portion to move the heat sink from a loading position wherein the electronic assembly can be inserted into the holder, to a testing position wherein the heat sink is located next to the electronic assembly with the thermal interface component between the surface of the heat sink and the electronic assembly and contacting the electronic assembly.

In a majority of constructions, the lid assembly is pivotally connected to the socket, and the IC chip is held in the socket between the lid assembly and the socket by closing the lid and securing it in a closed position with the use of a clamping or locking mechanism. For example, U.S. Patent Application Publication No. 2006/0110953 published in 2006 (inventor T. Allsup) discloses an IC test socket where an IC chip is placed into the socket and is pressed to the socket seat by two pivotally connected lid members fixed in place by latching mechanisms.

U.S. Pat. No. 6,353,329 issued in 2002 to H. Kiffe discloses an integrated circuit test socket lid assembly that is intended for pivotal connection to the socket body by a hinge and is rotatable between a closed position and an open position. However, the lid assembly can be disconnected from the socket body without tools. The lid assembly includes a frame member secured to the hinge, and a pressure plate and actuation member contained within the frame member. The bottom surface of the pressure plate includes a plurality of channels extending from an open central portion to the circumference of the pressure plate for permitting thermal air flow over the integrated circuit. A preferred embodiment of the lid assembly provides a visual indication to the user when an integrated circuit is undergoing testing.

U.S. Pat. No. 5,808,474 issued in 1998 to J. Hively, et al. discloses a socket for testing an integrated circuit ball grid array package having external contacts formed by an array of solder balls. In this device, the lid that clamps the object to be tested in the socket is separated from the socket body and is fixed in place by flexible latching fingers that lock into recesses formed in the outer side walls of the socket body.

U.S. Pat. No. 6,710,612 issued in 2004 to W. Farnworth, et al. discloses a BGA test socket for use in standard testing and burn-in testing of BGA dice and method for testing such dice is disclosed wherein a die contact insert made of silicon or ceramic using standard IC fabrication technology is used. Through using such an insert, even small scale (pitch) BGA dice can be reliably tested including chip scale packaged ("CSP") BGA dice. Furthermore, using such an insert allows a conventional socket to be adapted for use with a wide variety of both BGA dice and other varieties. A method for using the device is disclosed which overcomes current static electricity problems experienced in testing CSP BGA dice through closing the test socket before removing the die deposit probe.

An attempt to solve the problems of alignment and pressure application function is made in the device of U.S. Pat. No. 6,152,744 issued in 2000 to R. Maeda. This patent discloses a circuit socket having electrically conductive pads formed on a resilient circuitry component for contacting the terminals of an integrated circuit (IC) package which is positioned on the resilient circuitry. The electrically conductive pads are arranged around the center area of the resilient circuitry to be in one-to-one correspondence with the terminals of the IC package. The electrically conductive pads have individual circuit paths of substantially the same length and extend outwardly from the center area of the flexible circuitry. Additional electrically conductive pads are formed on the back side of the flexible circuitry in order to effect the required electrical connections to exterior circuits. These electrically conductive pads on the back side are connected to the conductor pattern on the front side by conductive through holes. With this arrangement all conductors have the same, reduced inductance. An insulative apertured film is preferably positioned intermediate to the IC package and to the flexible circuitry having the electrically conductive pads in order to perform certain alignment and pressure application functions.

Common drawbacks of known test sockets consist of insufficiently uniform pressure on the interface between the pusher and the IC chip in a clamped position of the chip, lack of self-alignment, insufficient removal of heat from the tested chips during the test, short service life of the lid-socket assembly in case of frequent use, and relatively long time required for setting an IC chip in the socket for testing.

SUMMARY OF THE INVENTION

It is an object of the present invention to provide an IC test socket with uniform contact on the interface between the pusher and the IC chip in a clamped position of the chip. It is another object to provide an IC test socket that ensures uniform distribution of the clamping force and uniform transfer of heat from the chip to the heat sink. Still another object is to provide a test socket where, in order to compensate for manufacturing inaccuracies and dimensional variations in IC chips, the chip clamping member has several degrees of freedom. It is another object to provide a test lid-socket assembly that is characterized by long service life, good heat-removing conditions, quick setting of an IC in the socket for testing, and convenience in use.

In general, the test lid-socket assembly of the present invention consists of a socket sub-assembly for holding an item to be tested, e.g., an IC chip, in place during testing, and a lid and pusher sub-assembly that is separated from the socket sub-assembly and that can be easily and quickly connected to the latter by means of a transversely sliding locking mechanism.

The socket sub-assembly consists of three main parts: a pin retainer, a socket body supported by the pin retainer, and a floating base insertable into the recess of the socket body. The construction of the socket sub-assembly is conventional, except that the socket body has recesses on its upper face for locking the spherical ends of spring plungers on the mating side of the lid sub-assembly and guiding elements on the socket and the lid for aligning the spring plungers with the respective openings of the socket body. The socket body has a plurality of holes for insertion of a plurality of pogo pins so that the lower contact ends of the pogo pins can project through the holes and be retained by the pin retainer to which the socket body is connected. The floating base is supported by the socket body via a set of uniformly distributed compression springs and has a possibility for vertical movements limited by heads of the screws threaded into the respective openings of the socket body.

The main distinguishing feature of the present invention is the construction of the lid sub-assembly that can be realized in several embodiments. According to one embodiment, the lid sub-assembly has a rectangular frame with a central opening for a pusher and a rectangular lid that is pivotally connected to the frame at one side of the latter so that the lid can be turned up to provide access to the recess of the socket for inserting the IC chip that has to be tested and for turning the lid down for clamping the IC chip in the position for testing. The pusher is made in the form of a cylindrical body with a lower flange and with two diametrically arranged shafts that are inserted into a vertical slot of the pusher body for limited freedom of movement in the vertical direction and that project radially outward from the cylindrical part of the pusher. These shafts are also inserted into respective openings formed in mating side walls of the lid in order to attach the pusher in the lid with possibility of rocking or pivotal movements of the pusher relative to the lid. The upper side of the lower flange of the pusher supports a plurality of compression springs uniformly distributed in the circumferential direction. In a closed and locked position of the lid, the aforementioned springs are compressed between the lower side of the lid and the lower flange of the pivotally installed pusher through a shim and, along with the rocking movement of the pusher in the lid, provide the pusher with auto-alignment in the vertical direction with uniform distribution of the pressure applied from the pusher to the IC chip in the socket. According to another embodiment, the pusher has a composite structure and consists of two parts, one of which is telescopically inserted into the other with a plurality of springs between both parts of the pusher. The second part of the pusher also is pivotally supported on two shafts which can slide in a vertical slot of the first part of the pusher. Such a construction provides the pusher with additional degrees of freedom and further improves properties of self-alignment and uniformity of distribution of pressure applied to the IC chip.

The transversely sliding locking mechanism of the lid is comprised of a device with a pair of L-shaped latching elements that is pivotally attached to the side of the lid opposite to the connection of the lid to the frame, while the corresponding side of the frame has appropriate recesses with bearings so that the L-shaped latching elements can be turned and locked around the outer rings of the bearings for locking the lid to the frame and simultaneously pressing the lower end face of the pusher to the upper side of the IC chip for fixing it in the socket with uniformly distributed compression force and in a self-aligned position. A heat-removing structure may consists of a heat sink attached to the upper side of the pusher and projected through the opening provided in the central part of the lid, or a heat-removing structure may be comprised of a separate heat sink attached to the upper surface of the lid. In this case, the heat sink, in turn, may support a fan, and the lid may have a central opening for unobstructed passage of heat-removal flow from the IC chip.

DETAILED DESCRIPTION OF THE INVENTION

Figure 1:
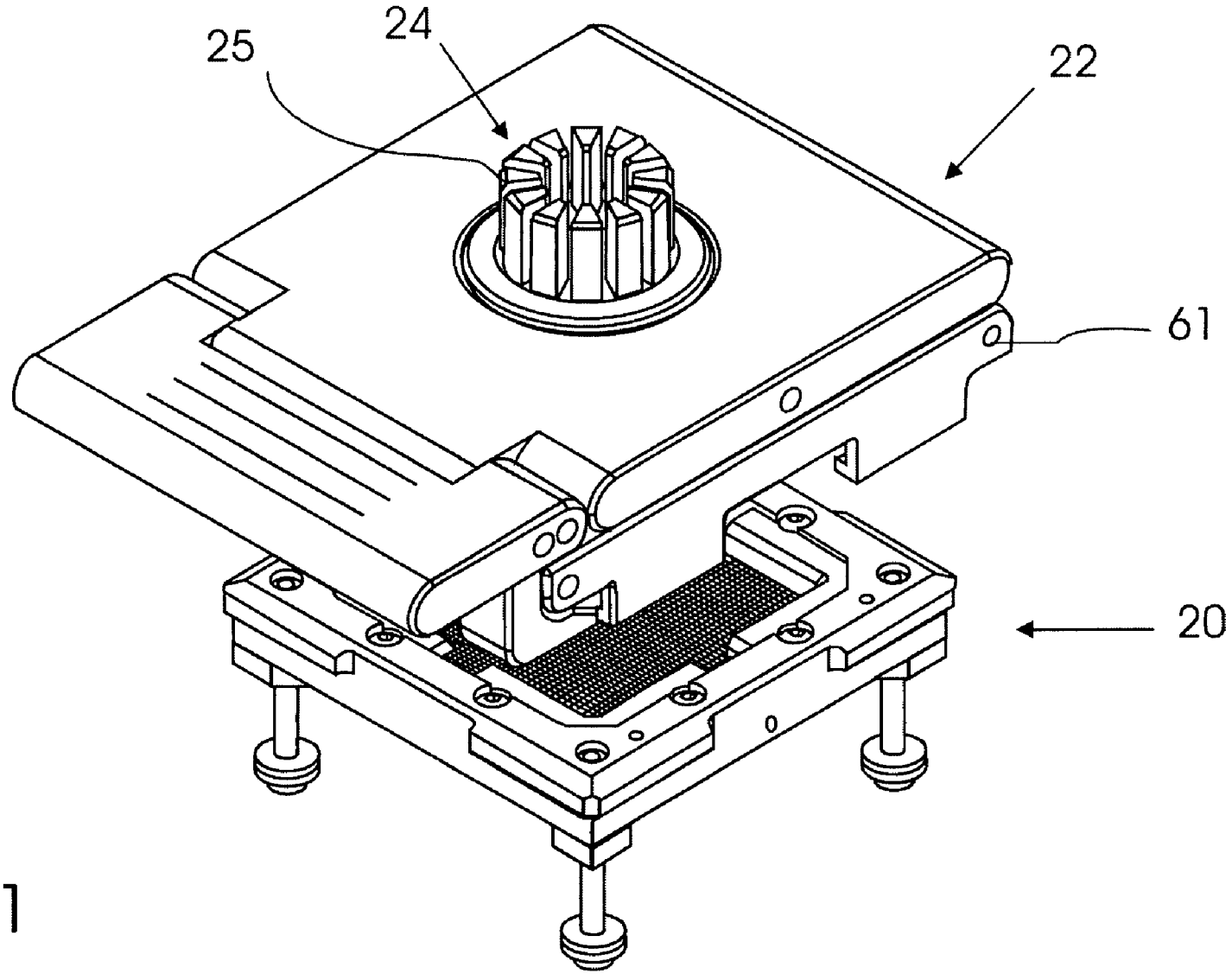
FIG. 1 is a general three-dimensional view of a lid-socket assembly of the invention for retaining electronic devices, e.g., IC chips, in a fixed position for testing their properties.
Figure 2:
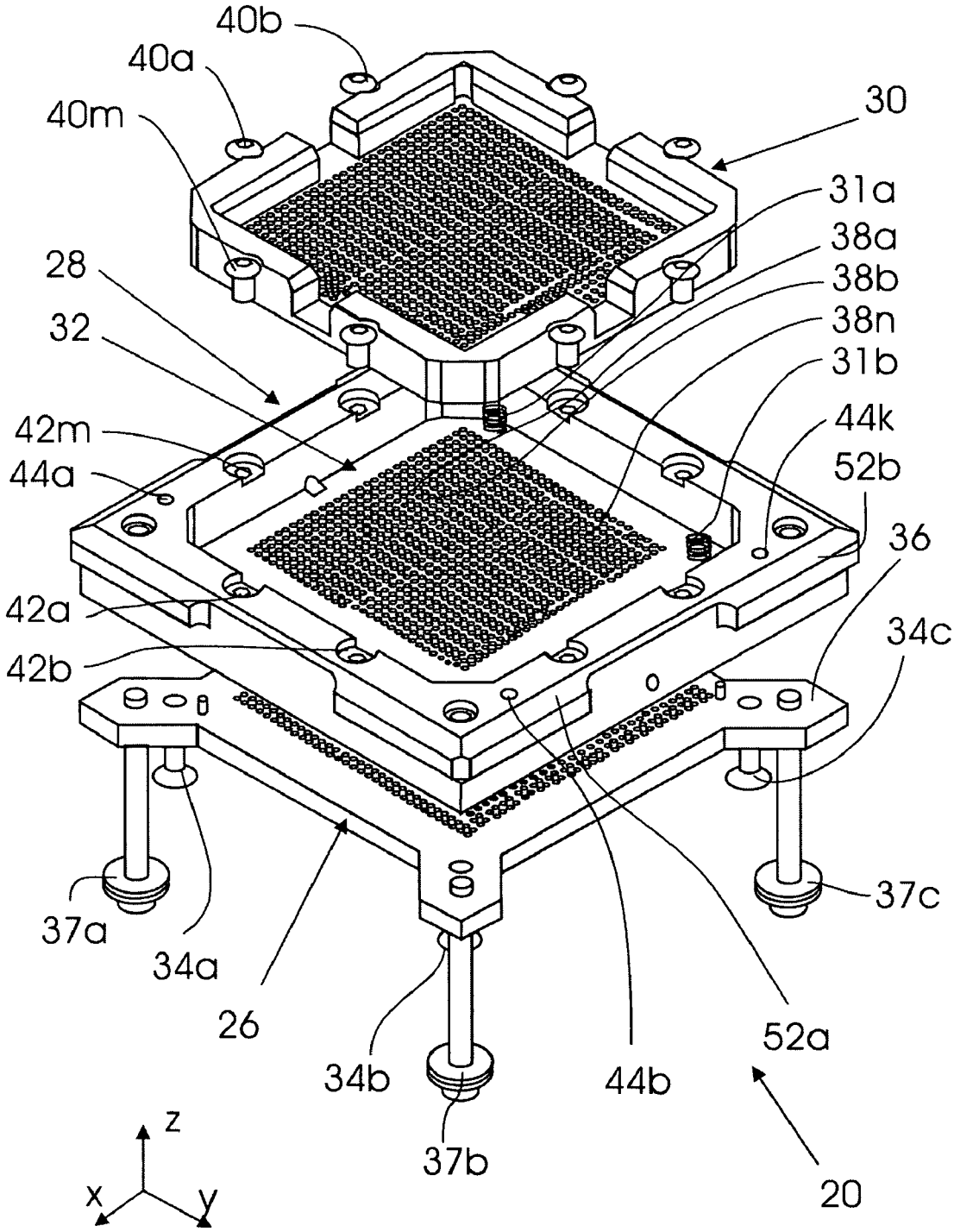
FIG. 2 is an exploded three-dimensional view of the socket sub-assembly of the invention.
Figure 3:
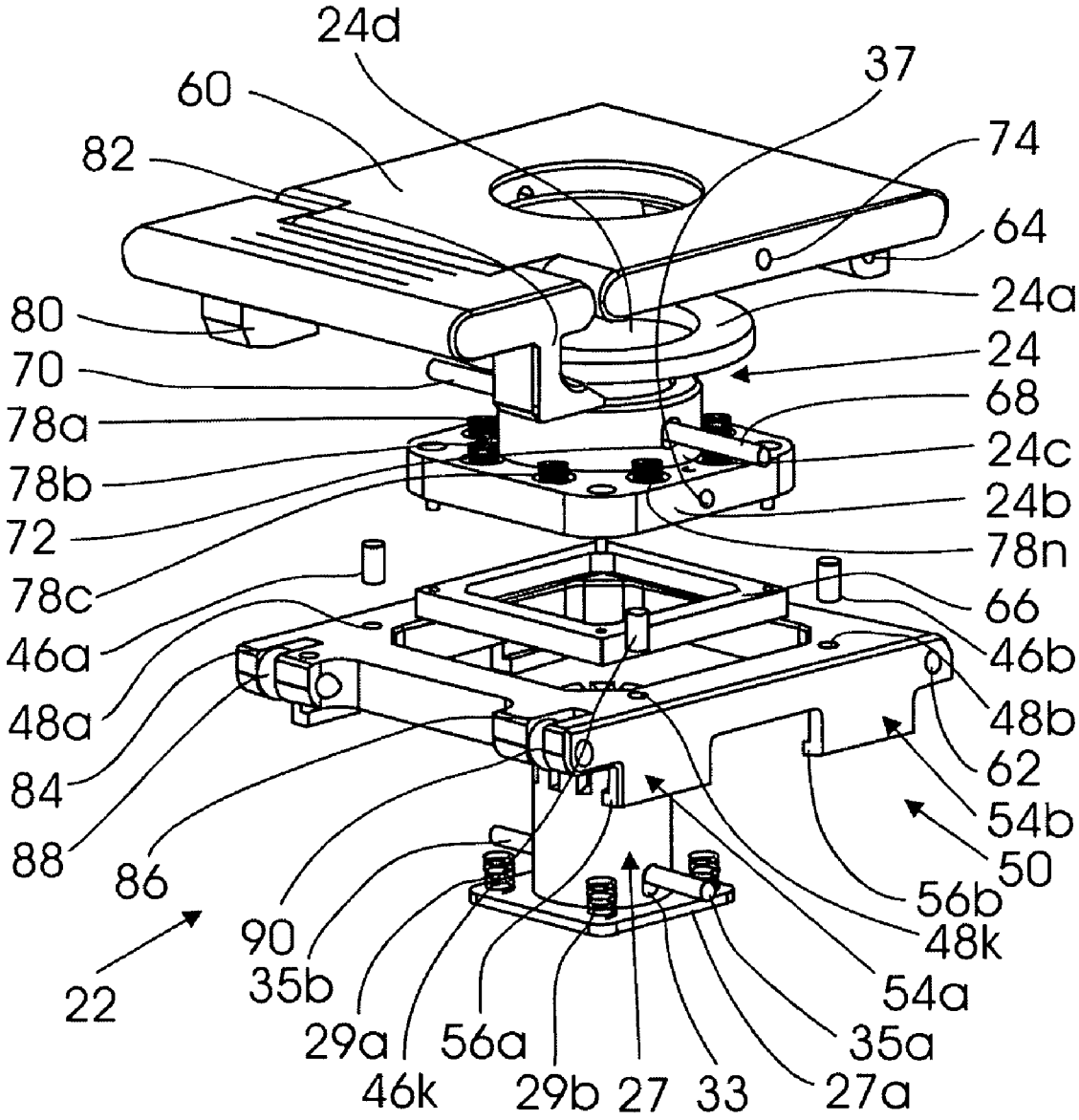
FIG. 3 is an exploded three-dimensional view of the lid sub-assembly of the invention.
Figure 4:
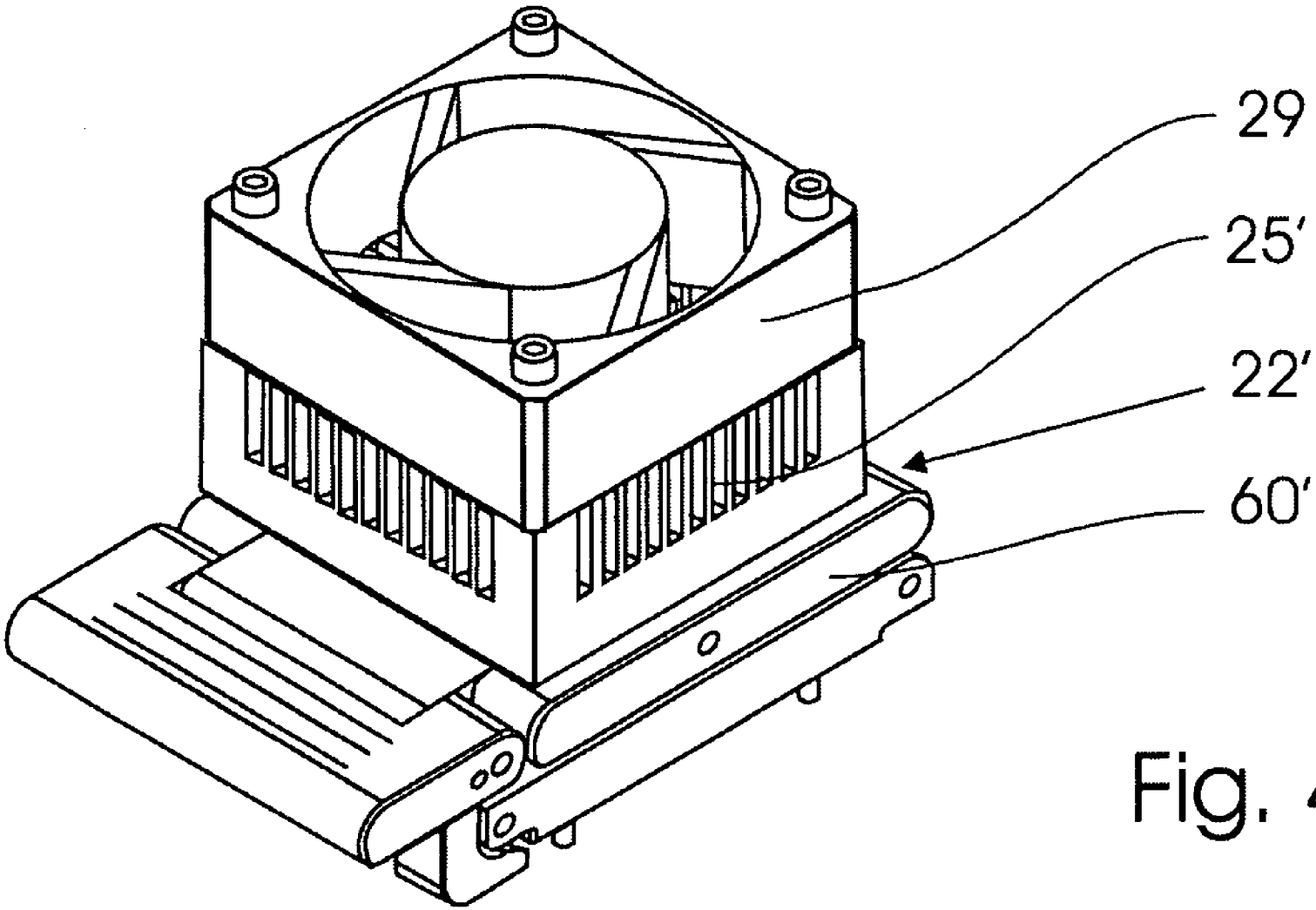
FIG. 4 is a three-dimensional view of the lid sub-assembly according to another embodiment of the invention wherein the heat-sink structure is provided with a cooling fan.

FIG. 1 is a general three-dimensional view of a lid-socket assembly of the invention for retaining electronic devices, e.g., IC chips, in a fixed position for testing their properties. It can be seen that the assembly consists of a socket sub-assembly 20 and a lid sub-assembly 22 that can be quickly and easily attached to the socket sub-assembly 20 by means of a locking mechanism (not shown in FIG. 1). Furthermore, the lid-sub-assembly supports a pusher 24, only a heat-sink portion 25 of which is seen in FIG. 1. FIG. 2 is an exploded three-dimensional view of the socket sub-assembly 20, and FIG. 3 is an exploded three-dimensional view of the lid sub-assembly 22. The pusher 24 may be realized in different embodiments. In the embodiment shown in FIG. 1, the heat sink member 25 is formed on the upper end of the pusher and projects outward through the central opening of the lid sub-assembly 22. FIG. 4 is a three-dimensional view of a lid sub-assembly 22' in a closed state with a heat sink member 25' that is attached to the upper part of the lid sub-assembly and that supports a cooling fan 27.

Having described the main sub-assemblies in general, let us consider them separately in more detail.

The socket sub-assembly 20 is shown in FIG. 2, which is an exploded three-dimensional view of this sub-assembly. The latter consists of three main parts: a pin retainer 26, a socket body 28 supported by the pin retainer 26, and a floating base 30 insertable into a recess 32 of the socket body 28. The pin retainer 26 is supported by four screws 34*a*, 34*b*, 34*c*, . . . The pin retainer attachment screws 34*a*, 34*b*, 34*c*, . . . attach a pin retainer plate 36 to the socket body 28. Reference numerals 37*a*, 37*b*, 37*c* . . . designate screws for attaching the socket subassembly 20 to the PCB (not shown). The function of this plate is to retain the ends of a plurality of pogo pins (not shown) that project through a plurality of openings 38*a*, 38*b* . . . 38*n* formed in the socket body 28. The number of such pogo pins and respective openings may vary in a wide range from several tens to several thousand.

The floating base 30 is supported by the socket body 28 via a set of uniformly distributed compression springs, such as springs 31*a* and 31*b* (only two of such springs are shown in FIG. 2) and has a possibility for a vertical movements in the direction of axis Z limited by heads of the screws 40*a*, 40*b*, . . . 40*m* threaded into the respective openings 42*a*, 42*b*, . . . 42*m* of the socket body 28.

For attachment of the lid sub-assembly 22, which will be described later the socket body 28 has on its upper face openings 44*a*, 44*b*, . . . 44*k* for locking the spherical ends of spring plungers 46*a*, 46*b* . . . 46*k* shown in FIG. 3 and located on the mating side of the lid sub-assembly 22. The aforementioned spring plungers 46*a*, 46*b*, . . . 46*k* are commercially produced parts that comprise tubular bodies with an outer thread that contain plungers with spherical ends that project from the tubular bodies and that are spring-loaded by springs inserted into the tubular bodies. Such spring plungers are produced, e.g., by S & W manufacturing Co., Inc., Illinois (http://www.swmanufacturing-.com/sub/ball_spring_plungers.asp). The plungers 46*a*, 46*b* . . . 46*k* are screwed into openings 48*a*, 48*b*, . . . 48*k* of a frame 50 (FIG. 3) of the lid sub-assembly 22 so that the spherical ends of the plungers project from the lower side of the frame 50 in order to lock into the respective openings 44*a*, 44*b*, . . . 44*k* on the upper face of the socket body 28 (FIG. 2) (more detailed description of the lid sub-assembly 22 with reference to FIG. 3 will be given later).

For the same purpose of attachment of the lid sub-assembly 22 to the socket body 28, the latter has guide flanges, only two of which, i.e., 52*a* and 52*b* are seen in FIG. 2. These guide flanges project outward from the side surfaces of the socket body 28, while the frame 50 of the lid sub-assembly 22 has on its lower side respective L-shaped members 54*a* and 54*b* with inward-projecting portions 56*a* and 56*b*, respectively, that can slide sidewise along the guide flanges 52 and 52*b* for guiding the lid sub-assembly in the transverse direction of axis Y (FIG. 2) until the spherical ends of the plungers 46*a*, 46*b* . . . 46*k* lock into the respective openings 44*a*, 44*b*, . . . 44*k* of the socket body.

As shown in FIG. 3, the lid sub-assembly 22 consists of the aforementioned rectangular frame 50 and a lid member 60 that is pivotally connected on pins such as a pin 61, which is the only one seen in FIG. 1. These pins are inserted into openings, such as an opening 62 in the frame 50 and an opening 64 in the lid member (in FIG. 3, the pivot connection elements are seen only on one side of the sub-assembly). As a result, the lid member 60 can be turned up relative to the frame 50 to provide access to the recess of the socket body 28 (FIG. 2) for inserting the IC chip (not shown) that has to be tested, or for turning the lid member 60 down for clamping the IC chip in the position for testing.

In the embodiment shown in FIG. 3, the pusher 24 consists of two main parts, i.e., an outer cylindrical body 24*c* with a shim 24*a* and lower flange 24*b*, and an inner cylindrical body 27 that is inserted into an opening 24*d* of the outer cylindrical body 24*c*. The lower flange 24*b* of the outer cylindrical body is attached to the upper surface of an adapter 66. The cylindrical part of the pusher 24, which is hollow and has the opening 24*d*, is located between the shim 24*a* and the lower flange 24*b* and has two diametrically arranged shafts 68 and 70 that are inserted into a vertical slot 72 of the pusher body for limited freedom of movement in the direction of axis Z (FIG. 2) and project radially outward from the cylindrical part of the pusher. These shafts 68 and 70 are inserted into respective openings, only one of which, i.e., an opening 74, is seen in FIG. 3. These openings are formed in mating side walls of the lid member 60 in order to attach the inner pusher 24 to the lid member with possibility of rocking or pivotal movements of the pusher 24 relative to the lid member 60. The shim 24*a* of the pusher 24 abuts the lower surface of the lid member 60, while the upper side of the lower flange 24*b* of the pusher 24 supports a plurality of compression springs 78*a*, 78*b*, 78*c*, . . . 78*n* uniformly distributed in the circumferential direction around the cylindrical portion.

The inner cylindrical body 27 also contains a flange 27*a* that support a plurality of springs 29*a*, 29*b*, . . . These springs are compressed between the flange 27*a* of the inner cylindrical body and the lower flange 24*b* of the outer cylindrical body 24*c*. The inner cylindrical body 27 also has a slot 33 that extends in the direction of axis Z (FIG. 2) and contains shafts 35*a* and 35*b* that are inserted into the slot 33. The outer ends of the pins 35*a* and 35*b* are inserted into openings of the lower flange 24*b* of the cylindrical body 24*c* (only one such opening 37 is shown in FIG. 3). Thus, the outer cylindrical body 24*c* of the pusher 24 together with the lid member 60 may perform vertical movements on springs 29*a*, 29*b*, . . . relative to the inner cylindrical body due to sliding of the shafts 35*a* and 35*b* in the slot 33 and also can perform pivotal or rocking movements around shafts 29*a* and 29*b*.

In a closed and locked position of the lid member 60, the aforementioned springs 78*a*, 78*b*, 78*c*, . . . 78*n* are compressed between the shim 24*a* and the lower flange 28*b* of the pivotally installed pusher 24 and, along with the rocking movement of the pusher 24 in the lid member 60 on the shafts 68 and 70, the aforementioned springs provide the pusher 24 with auto-alignment in the direction of axis Z (FIG. 2) and with uniform distribution of the pressure applied from the pusher 24 to the IC chip in the socket sub-assembly 20 (FIG. 1). The springs 29*a*, 29*b* . . . are also compressed between the lower flange 24*b* and the flange 27*a* of the inner cylindrical body.

The locking mechanism of the lid has a pair of L-shaped latching elements 80 and 82 and is pivotally attached to the side of the lid opposite to the connection of the lid to the frame (i.e., to the pin 61 shown in FIG. 1), while the corresponding side of the frame has appropriate recesses 84 and 86 with bearings 88 and 90, so that the L-shaped latching elements 80 and 82 can be turned and locked around the outer rings of the bearings 88 and 90 for locking the lid member on the frame 50 and simultaneously pressing the lower end faces of the adapter 66 and of the inner pusher 27 to the upper side of the IC chip (not shown) for fixing it in the socket sub-assembly 20 with uniformly distributed compression forces and in a self-aligned position. Uniform distribution of forces is possible due to provision of a plurality of springs 78*a*, 78*b*, . . . 78*n* between the lower flange 24*b* of the pusher and the lid member and a plurality of springs, such as springs 31*a* and 31*b*, located between the floating base 30 and the socket body 28. Self-alignment is possible due to the fact that during fixation of an IC chip in the recess of the floating base 30 of the socket sub-assembly 20 the pusher 24 has five degrees of freedom relative to the socket sub-assembly 20, i.e., 1) freedom of movement of the outer cylindrical body 24*c* of the spring-loaded pusher 24 relative to the lid member 60 due to sliding of the shafts 66 and 68 in the direction of axis Z (FIG. 2) in the slot 72 of the lid member 60; 2) rocking or pivotal movements of the outer cylindrical body 24*c* on shafts 68 and 70; and 3) freedom of movement of the outer cylindrical body 24*c* together with the entire lid sub-assembly 22 in the direction of axis Z on springs such as springs 31*a* and 31*b* (FIG. 2) relative to the socket sub-assembly 20; 4) freedom of movement of the inner pusher 27 relative to the outer cylindrical body 24*c* in the direction of axis Z (FIG. 2) due to movement of the shafts 29*a* and 29*c* in the slot 33; and 5) rocking movement of the inner cylindrical body 27 relative to the outer cylindrical body 24*c*.

According to the embodiment shown in FIG. 1, a heat-removing structure may consist of a heat sink 25 attached to the upper side of the pusher 24 and projecting through the central opening 76 of the lid member 60 provided in the central part of the lid.

According to the embodiment shown in FIG. 4, the heat-sink structure is comprised of a separate heat sink 25' attached to the upper surface of the lid member 60'. In this case, the heat sink 25', in turn, may support a cooling fan 29, and the lid member may have the central opening 76 (FIG. 3) for unobstructed passage of heat-removal flow from the IC chip.

Figure 5:
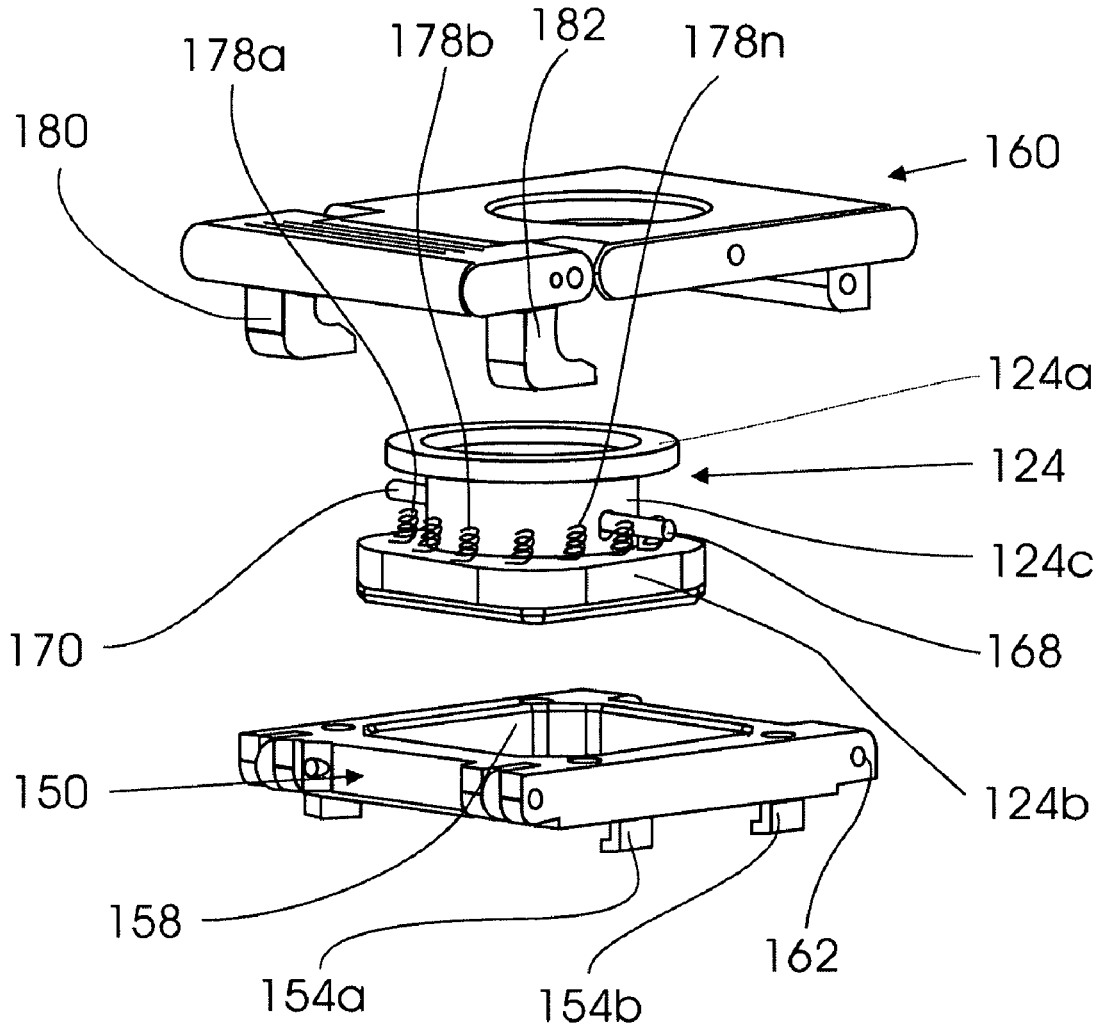
FIG. 5 is an exploded three-dimensional view of the lid sub-assembly of the invention with another modification of the pusher.

FIG. 5 is an exploded three-dimensional view of the lid sub-assembly 122 of the invention with another modification of the pusher 124. Those parts of this sub-assembly which are identical to similar parts of the sub-assembly 22 shown in FIG. 3 are designated by the same reference numerals with addition of 100 and their description is omitted. For example, the lid member is designated by reference numeral 160, the pusher is designated by reference numeral 124, etc. The embodiment of FIG. 5 differs from the one shown in FIG. 3 in that the pusher 124 is made as a single part, i.e., without division into the inner and outer cylindrical bodies and comprises a cylindrical body 124*c* with a shim 124*a* that abuts against the lower side of the lid member 160 and the lower flange 124*b* that supports a plurality of springs 178*a*, 178*b*, . . . 178*n*. The lower flange 124*b* of the pusher passes through the opening 158 of the frame 150 towards an IC chip (not shown) that is inserted into the socket body 28 of the socket sub-assembly 20 (FIG. 2). The rest of the construction of FIG. 5 is the same as the one shown in FIG. 3. In the lid-socket assembly of the type that utilizes the lid sub-assembly shown in FIG. 5, the pusher 124 will have the following three degrees of freedom: 1) freedom of movement of the spring-loaded pusher 124 relative to the lid member 160 due to sliding of the shafts 166 and 168 in the direction of axis Z (FIG. 2) in the slot 172 of the lid member 160; 2) rocking or pivotal movements of the outer cylindrical body 124*c* on shafts 168 and 170; and 3) freedom of movement of the pusher 124 together with the entire lid sub-assembly 122 in the direction of axis Z on springs such as springs 31*a* and 31*b* (FIG. 2) relative to the socket sub-assembly 20.

Thus it has been shown that the invention provides an IC test socket with uniform contact on the interface between the pusher and the IC chip in a clamped position of the chip. The IC test socket of the invention ensures uniform distribution of the clamping force and uniform transfer of heat from the chip to the heat sink. The chip clamping member of the device has several degrees of freedom. The test lid-socket assembly of the invention is characterized by long service life, good heat-removing conditions, quick setting of an IC in the socket for testing, and convenience in use.

Although the invention has been shown and described with reference to specific embodiments, it is understood that these embodiments should not be construed as limiting the areas of application of the invention and that any changes and modifications are possible, provided these changes and modifications do not depart from the scope of the attached patent claims. For example, the lid sub-assembly shown and described in the specification may be used in combination with different socket sub-assemblies. The number of springs may be different. The heat-removing system may have a structure different from the heat sink and heat-sink-fan system described and shown in the drawings. For example, water cooling systems, Peltier cooling systems, or the like can be used. The number of spring plungers may be different, and latching mechanisms other than those shown and described can be used for locking the lid member to the frame. The spring plungers can be replaced by locking mechanisms of other types, e.g., by spring-loaded balls or pins inserted into the lid member. The parts can be made from different materials, and the items to be tested may not necessarily be IC chips, e.g., individual multiple-contact electronic elements, dices, etc. The device may be used for testing, measuring characteristics of the test items, or for burn-in test. The pusher may comprise a single part and may have three degrees of freedom instead of five.

The invention claimed is:

1. A test socket-lid assembly for testing electronic devices comprising: a socket sub-assembly with means for accommodating an electronic device to be tested; and a lid-sub-assembly, which is separated from said socket sub-assembly and comprises a transversely sliding locking mechanism for locking to said socket sub-assembly, a frame, a lid member pivotally connected to one end of said frame, a spring-loaded pusher between said frame and said lid member, and a latching mechanism for locking said lid member to said frame simultaneously with pressing said pusher toward said socket sub-assembly; said socket sub-assembly having means for engagement with said transversely sliding locking mechanism of said lid sub-assembly.

2. The test socket-lid assembly of claim 1, wherein said pusher together with said lid sub-assembly has at least three degrees of freedom relative to said socket sub-assembly.

3. The test socket-lid assembly of claim 1, wherein said pusher together with said lid sub-assembly has five degrees of freedom relative to said socket sub-assembly.

4. The test socket-lid assembly of claim 1, wherein said pusher has a first set of a plurality of springs located between said pusher and said lid member and means for sliding movement of said pusher relative to said lid member in the direction toward said socket sub-assembly.

5. The test socket-lid assembly of claim 4, wherein said means for sliding movement of said pusher relative to said lid member comprises a first slot formed in said pusher, and a first pair of pins having one ends inserted into said first slot and the other ends secured in said lid member for pivotal movements of said lid member on said first pair of pins.

6. The test socket-lid assembly of claim 5, wherein said pusher has a composite structure and comprises an outer cylindrical body that supports said first pair of pins and has said first slot and an inner cylindrical body inserted into said outer cylindrical body and having a second slot and a second pair of pins with one ends of said second pair of pins being inserted into said second slot and the other ends secured in said first cylindrical body for pivotal movements of said second cylindrical body relative to said first cylindrical body; and a second set of a plurality of springs located between said first cylindrical body and said second cylindrical body; said first set of a plurality of springs being located between said lid member and said outer cylindrical body.

7. The test socket-lid assembly of claim 1, wherein said transversely sliding lock mechanism comprises a plurality of spring plungers inserted into said lid member and wherein said means for engagement with said locking mechanism of said lid sub-assembly on said socket sub-assembly comprise a plurality of openings for engagement with said spring plungers.

8. The test socket-lid assembly of claim 7, wherein said transversely sliding locking mechanism further comprises guide members on said socket sub-assembly and guide members on said frame for guiding said lid sub-assembly on said socket sub-assembly in the transverse direction of said socket sub-assembly until reaching the position of alignment of said spring plungers with said plurality of openings for engagement with said spring plungers.

9. The test socket-lid assembly of claim 2, wherein said transversely sliding locking mechanism comprises a plurality of spring plungers inserted into said lid member and wherein said means for engagement with said transversely sliding locking mechanism of said lid sub-assembly on said socket sub-assembly comprise a plurality of openings for engagement with said spring plungers.

10. The test socket-lid assembly of claim 9, wherein said transversely sliding locking mechanism further comprises guide members on said socket sub-assembly and guide members on said frame for guiding said lid sub-assembly on said socket sub-assembly in the transverse direction of said socket sub-assembly until reaching the position of alignment of said spring plungers with said plurality of openings for engagement with said spring plungers is reached.

11. The test socket-lid assembly of claim 3, wherein said transversely sliding locking mechanism comprises a plurality of spring plungers inserted into said lid member and wherein said means for engagement with said transversely sliding locking mechanism of said lid sub-assembly on said socket sub-assembly comprise a plurality of openings for engagement with said spring plungers.

12. The test socket-lid assembly of claim 11, wherein said transversely sliding locking mechanism further comprises guide members on said socket sub-assembly and guide members on said frame for guiding said lid sub-assembly on said socket sub-assembly in the transverse direction of said socket sub-assembly until reaching the position of alignment of said spring plungers with said plurality of openings for engagement with said spring plungers is reached.

13. The test socket-lid assembly of claim 6, wherein said transversely sliding locking mechanism comprises a plurality of spring plungers inserted into said lid member and wherein said means for engagement with said transversely sliding locking mechanism of said lid sub-assembly on said socket sub-assembly comprise a plurality of openings for engagement with said spring plungers.

14. The test socket-lid assembly of claim 13, wherein said transversely sliding locking mechanism further comprises guide members on said socket sub-assembly and guide members on said frame for guiding said lid sub-assembly on said socket sub-assembly in the transverse direction of said socket sub-assembly until reaching the position of alignment of said spring plungers with said plurality of openings for engagement with said spring plungers is reached.

15. The test socket-lid assembly of claim 1, wherein said latching mechanism comprises: latching elements pivotally connected to said lid member on the end thereof opposite to said one end of said frame which is pivotally connected to said lid member; and rotating members installed in said frame around which the latching elements lock.

16. The test socket-lid assembly of claim 15, wherein said rotating members are cylindrical bearings.

17. The test socket-lid assembly of claim 6, wherein said latching mechanism comprises: latching elements pivotally connected to said lid member on the end thereof opposite to said one end of said frame which is pivotally connected to said lid member; and rotating members installed in said frame around which the latching elements lock.

18. The test socket-lid assembly of claim 17, wherein said rotating members are cylindrical bearings.

19. The test socket-lid assembly of claim 1, further provided with heat-removing means that comprise a heat sink attached to the end of said pusher opposite to said socket sub-assembly.

20. The test socket-lid assembly of claim 19, wherein said heat-removing means is further provided with a cooling fan.

21. The test socket-lid assembly of claim 4, further provided with heat-removing means that comprise a heat sink attached to the end of said pusher opposite to said socket sub-assembly.

22. The test socket-lid assembly of claim 21, wherein said heat-removing means is further provided with a cooling fan.

23. The test socket-lid assembly of claim 6, further provided with heat-removing means that comprise a heat sink attached to the end of said pusher opposite to said socket sub-assembly.

24. The test socket-lid assembly of claim 23, wherein said heat-removing means is further provided with a cooling fan.

* * * * *